United States Patent [19]

Iwasaki

[11] Patent Number: 4,791,881

[45] Date of Patent: Dec. 20, 1988

[54] GRAVURE COATING DEVICE

[75] Inventor: Takashi Iwasaki, Samukawa, Japan

[73] Assignee: Yasui Seiki Co., Ltd., Tokyo, Japan

[21] Appl. No.: 895,304

[22] Filed: Aug. 11, 1986

[30] Foreign Application Priority Data

Sep. 6, 1985 [JP] Japan ..... 60-136404

[51] Int. Cl.[4] ..... B05C 1/08

[52] U.S. Cl. ..... 118/244; 118/212; 118/235; 118/259

[58] Field of Search ..... 118/212, 244, 259, 235

[56] References Cited

U.S. PATENT DOCUMENTS

| | | | |
|---|---|---|---|
| 1,793,082 | 2/1931 | Goss | 118/212 |
| 2,218,249 | 10/1940 | Nadeau et al. | 118/212 X |
| 2,396,946 | 3/1946 | Grupe | 118/212 X |
| 2,641,219 | 6/1953 | Tranter | 118/244 X |
| 2,787,244 | 4/1957 | Hecken | 118/259 |
| 2,918,393 | 12/1959 | Wommack et al. | 118/259 X |
| 3,630,835 | 12/1971 | Busch | 118/212 X |
| 4,241,690 | 12/1980 | Muller | 118/244 X |

FOREIGN PATENT DOCUMENTS

| | | |
|---|---|---|
| 25033 | 4/1973 | Japan . |
| 45812 | 10/1983 | Japan . |
| 223459 | 12/1983 | Japan . |

OTHER PUBLICATIONS

Handbook on Gravure Printing, Publication date: Jul. 25, 1981, Editor: Masayoshi Araki, Publisher: Kakou Gijutsu Kenkyujo, title page, pp. 463, 464, abstract page and English translation of p. 463.

*Primary Examiner*—John McIntosh

[57] ABSTRACT

A gravure coating device for applying a coating to a first side of a traveling continueous web. A pair of spaced rollers support the web on the second side while a gravure roller located between the rollers tangentially contacts the first side of the web. A doctor blade is utilized to remove excess coating from the gravure roller while a nozzle is utilized to apply the coating material to the gravure roller. Specific structure for the nozzle is disclosed.

7 Claims, 2 Drawing Sheets

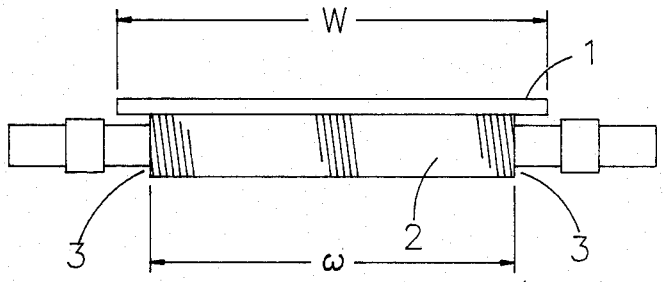
FIG. 1 -- Prior Art
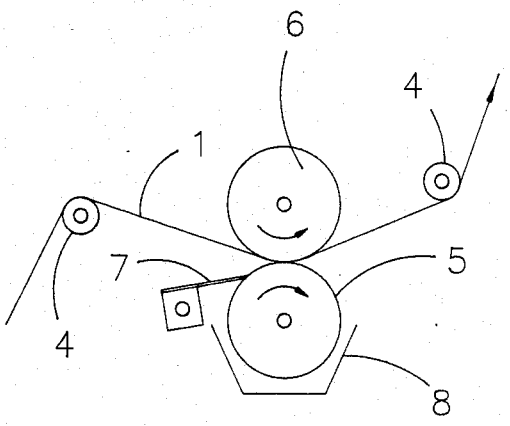
FIG. 2 -- Prior Art

GRAVURE COATING DEVICE

FIELD OF THE INVENTION

The present invention relates to a gravure coating device and more particularly a gravure coating device capable of coating a thin web and multi-color coating in a very satisfactory manner.

BACKGROUND OF THE INVENTION

In general, in the case of applying a coating, for instance, diluted coating and nondiluted coating, to a web of plastic film, paper or cloth, the phenomenon that the coating escapes from the surface being coated to the opposite surface of the web must be prevented.

Therefore so far the coating has been applied only to a portion whose width is shorter than the overall width of the web.

For instance, in the case of coating a web 1 with a wire bar 2 as shown in FIG. 1, reduced-diameter portions or steps 3 are formed at both of the end portions of the wire bar 2 so that the coating width w of the wire bar 2 is shorter than the overall width W of the web 1.

When the web 1 is sufficiently thick in thickness, no problem arises with the wire bar 2 with the stepped portions 3. But when the web 1 is considerably thin in thickness and, for instance, is 2–9$\mu$ in thickness, longitudinal wrinkles are produced on the surface of the web 1 at the portions thereof in contact with both of the stepped portions 3 of the wire bar 2 so that no satisfactory coating can be obtained.

In a prior art gravure coating device of the type shown in FIG. 2, when a coating is applied to a thin web, longitudinal wrinkles are produced on the surface of the thin web. The reason why such longitudinal wrinkles are produced is as follows. A coating applied to a gravure roll 5 is transferred to the under surface of a web 1 which is extended by extension rolls 4 and clamped under a suitable pressure between the gravure roll 5 and a rubber roll 6. As a result, when the web 1 is thin, longitudinal wrinkles are produced on the surface of the web 1 because of the clamping pressure. In FIG. 2, reference numeral 7 designates a doctor blade: and 8, a pan for storing a coating.

The same problem is encountered when a gravure coating device of the type as shown in FIG. 1 of U.S. Pat. No. 4,438,695 granted to Maier et.al. and a gravure coating device of the type as shown in FIG. 1 of U.S. Pat. No. 4,474,110 granted to Rosner are used.

BRIEF SUMMARY OF THE INVENTION

In view of the above, one of the objects of the present invention is to provide a gravure coating device capable of applying a coating to a thin web in a satisfactory manner without producing longitudinal wrinkles.

Another object of the present invention is to provide a gravure coating device capable of multi-color coating of a thin web without producing longitudinal wrinkles.

A further object of the present invention is to provide a gravure coating device capable of not only smoothing a coating applied to a thin web, but also precisely controlling the thickness of a coated layer on the thin web.

The above and other objects of the present invention can be attained in the following manner. That is, according to the present invention, a coating is transferred from a gravure roll onto the undersurface of a traveling continuous web at a position at which the upper surface of the web is maintained free. Of course, a doctor blade is used to wipe out an excessive amount of coating from the surface of the gravure roll immediately before the coating is transferred to the undersurface of the web. As described above, according to the present invention, the coating is applied by the gravure roll to the undersurface of the web whose upper surface is maintained free so that however thin the web is, the coating can b applied thereto always in a satisfactory manner without producing longitudinal wrinkles on the surface of the web.

According to the present invention, a plurality sets each comprising a gravure roll and a doctor blade are so disposed that they can be moved toward or away from the undersurface of the web, independently of each other and coatings of different colors are supplied to respective sets so that the coatings of various colors can be applied to a thin web without producing longitudinal wrinkles in a very satisfactory manner.

Furthermore, according to the present invention, the gravure roll can be rotated in the same direction or the opposite direction in which a thin web is transported and the peripheral velocity of the gravure roll is variable so that the smoothness of the coating applied to the thin web as well as the thickness of the layer of the coating on the thin web can be simply adjusted depending upon the purpose of coating.

As described above, according to the present invention, a web is not clamped between a pair of rolls, but is made into contact only with a gravure roll so that even when a web is thin, satisfactory coating can be attained without producing longitudinal wrinkles on the surface of the web. Moreover, the smoothness and thickness of the layer of coating applied to the web can be freely adjusted. Furthermore, multi-color coating can be accomplished by a simple arrangement. Thus, according to the present invention, coated articles having a high commercial value can be provided.

BRIEF DESCRIPTION OF THE DRAWINGS

FIG. 1 shows a prior art coating process with a wire bar:

FIG. 2 is a side view of a prior art gravure coating device;

DETAILED DESCRIPTION OF THE DRAWINGS

Figure 3:
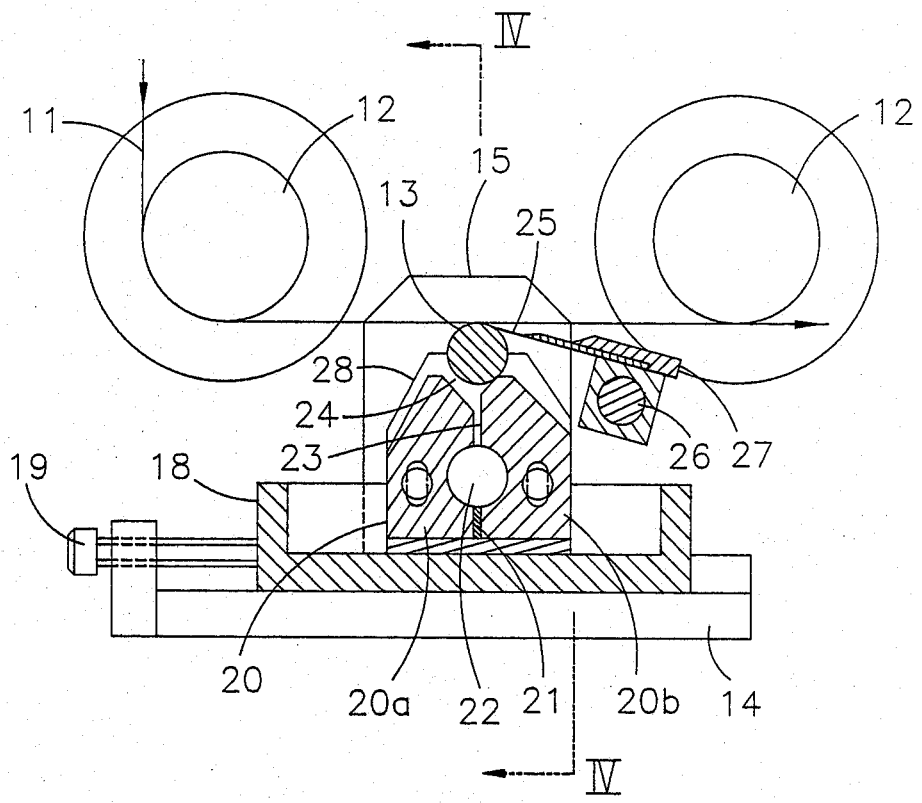
FIG. 3 is a longitudinal sectional view of a gravure coating device in accordance with the present invention.
Figure 4:
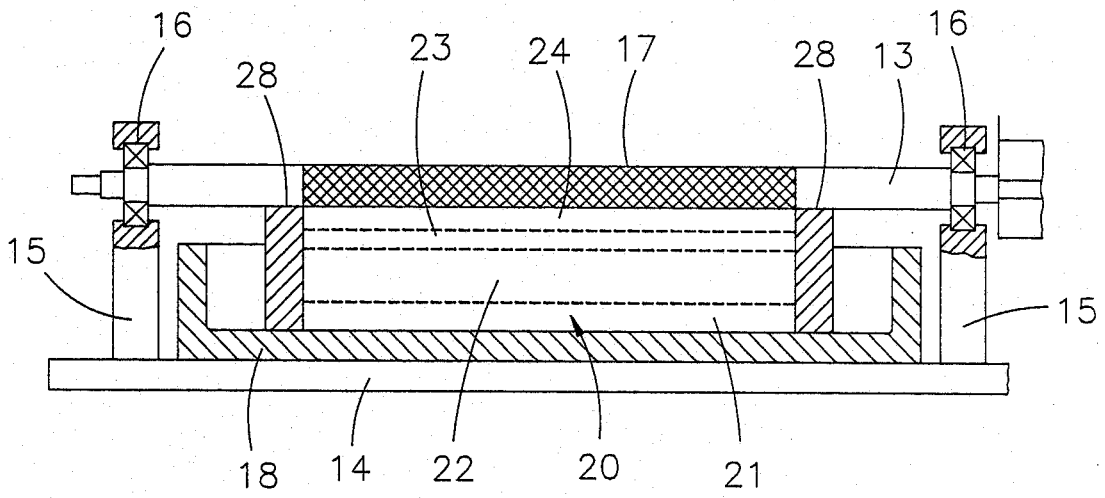
FIG. 4 is a sectional view, on reduced scale, taken along the line IV—IV of FIG. 3.

FIGS. 3 and 4 shows a preferred embodiment of the present invention or the best mode for carrying out the present invention.

In this embodiment, a continuous web 11 is transported horizontally from the left to the right in FIG. 3. The web 11 is unwound from a supply roll (not shown) and is extended by means of extension rolls 12 as shown in FIG. 3. Finally, the web is taken up by a take-up roll (not shown). A gravure roll 13 having a relatively small diameter of, for instance, 20 mm is disposed below the web 11 between the extension rolls 12 and is rotatably supported by bearings 16 at its ends which in turn are mounted on a pair of supporting members 15 mounted on a base 14 which is vertically movable by a suitable driving mechanism (not shown). The rotation of a driving motor (not shown) is transmitted through a coupling (not shown) to the gravure roll 13. In this embodiment, the gravure roll 13 is rotated in the direction opposite to the direction of transportation of the web 11 (in the counterclockwise direction in FIG. 3). An engraved portion 17 is formed over the outer cylindrical surface of the gravure roll 13 and is shorter in width than the gravure roll 13. An overflow container 18 is mounted on the base 14 below the gravure roll 13 and is securely held in position by means of a bolt 19. A coating supply nozzle 20 adapted to supply a coating to the gravure roll 13 is securely mounted in the overflow container 18 and is equal in width to the engraved portion 17 as shown in FIG. 4 As best shown in FIG. 3, the supply nozzle 20 comprises a pair of nozzle pieces 20*a* and 20*b* which are securely joined to each other at their lower portions with a thin insert 21 interposed therebetween. A coating reservoir 22 which is circular in cross section, is extended in the widthwise direction of the supply nozzle 20 and is adapted to temporarily receive therein the coating supplied from the exterior is defined above the thin insert 21. Since no insert is interposed between the nozzle pieces 20*a* and 20*b* above the reservoir 22, an elongated communication groove 23 is defined. A top-open elongated nozzle portion 24 is defined at the upper end of the supply nozzle 20 so that the coating which is supplied from the reservoir 22 through the communication groove 23 may be stored therein and then applied to the engraved portion 17 of the gravure roll 13. The length of the nozzle portion 24 is made equal to the width of the engraved portion 17 of the gravure roll 13 and plug members 28 for controlling the width of the nozzle portion 24 are securely attached to the ends of the supply nozzle 20. A doctor blade 25 is provided which is adapted to wipe out an excessive amount of the coating applied to the engraved portion 17 immediately before the engraved portion 17 applies the coating stored in the nozzle portion 23 to the undersurface of the web 11. The doctor blade 25 is attached to a holder 27 which in turn is pivotally carried by a pivot shaft 26 extended in parallel with the gravure roll 13. The doctor blade 25 has a double function of applying a suitable amount of the coating to the engraved portion 17 over the whole width thereof and wiping out the coating from the portions of the gravure roll 13 extended outwardly beyond the ends of the engraved portion 17.

Next the mode of operation of the gravure coating device with the above-described construction will be described.

First, the web 11 is transported at a predetermined velocity from the left to the right in FIG. 3 and simultaneously the coating is fed from the reservoir 22 through the communication groove 23 into the nozzle portion of the supply nozzle 20 while the gravure roll 13 is rotated in the counterclockwise direction in FIG. 3. Therefore, the lower portion of the engraved portion 17 of the gravure roll 13 is immersed in the coating in the nozzle portion 24 so that the coating is applied to the surface of the engraved portion 17 and approaches the doctor blade 25 as the gravure roll 13 and hence the engraved portion 17 are rotated. In this case, it is preferable that the quantity of the coating fed into the nozzle portion 24 is equal to or slightly greater than the quantity of the coating applied to the engraved portion 17. The coating applied to the engraved portion 17 is wiped out by the doctor blade 25 so that a suitable quantity of the coating remains over the surface of the engraved portion 17 over its whole width. The excessive coating wiped out by the doctor blade 25 is applied again to the engraved portion 17 or flows over the outer surface of the supply nozzle 20 into the overflow reservoir 18 and then into the reservoir 22. When a suitable quantity of the coating is applied to the engraved portion of the gravure roll 13 in the manner described above, the gravure roll 13 is raised in unison with the base 14 so that the engraved portion 17 of the gravure roll 13 is made into contact with the undersurface of the web 11 and consequently the coating applied on the engraved portion 17 is transferred to the undersurface of the web 11. It should be noted that the direction of the transportation of the web 11 and the direction of rotation of the engraved portion 17 ar opposite to each other at the line of contact therebetween so that the engraved portion 17 slips relative to the undersurface of the web 11. As a result, the pattern of the engraved portion 17 transferred to the undersurface of the web 11 slips in the direction opposite to the direction of transportation of the web 11 so that the coating is uniformly and smoothly applied to the undersurface of the web 11. The smoothness of the coating is adjusted by varying the relative velocity difference between the web 11 and the gravure roll 13. Therefore, according to the present invention, a smoothing device can be eliminated. In addition, no working rubber roll is disposed in opposed relationship with the gravure roll 13 so that even when the web 11 is thin, no longitudinal wrinkles are produced on the web 11 and the coating can be applied to the undersurface of the web 11 in a very satisfactory manner. Moreover, as compared with a conventional gravure roll whose are of contact with the undersurface of a web is large, the area of contact between the gravure roll 13 and the undersurface of the web 11 becomes extremely small because the diameter of the gravure roll 13 is small so that the contact with and separation from the web 11 of the gravure roll 13 are much facilitated. As a result, not only the position at which the coating is applied to the undersurface of the web 11 but also the position at which the coating operation is interrupted can be precisely controlled. Furthermore, the cost of the gravure roll 13 can be reduced and the gravure coating device can be made compact in size and light in weight as a whole.

In FIG. 3, the gravure roll 13 is rotated in the direction opposite to the direction of the transportation of the web 11, but it is to be understood that the doctor blade 25 is disposed at the opposite position with respect to the gravure roll 13 while the gravure roll 13 is rotated in the clockwise direction in such a way that a relative velocity difference is produced between the web 11 and the gravure roll 13, whereby the coating is smoothly applied to the undersurface of the web 11. In the latter case, when the peripheral velocity of the gravure roll 13 is faster than that of the web 11 and especially when the peripheral velocity of the gravure roll 13 is twice as fast as the velocity of the web 11, the smoothness of the coating applied on the undersurface of the web 11 is considerably enhanced.

When the viscosity of the coating is high, the gravure roll 13 is rotated in the direction opposite to the direction of the transportation of the web 11, but when the viscosity of the coating is low, the gravure roll 13 is rotated in the direction in which the web 11 is transported. In this way, the coating applied to the undersurface of the web 11 becomes satisfactorily smooth. Furthermore when the rotational speed of the gravure roll 13 is so varied that the relative velocity between the web 11 and the gravure roll 13 is adjusted suitably, not only the smoothness of the coating applied to the undersurface of the web 11 is ensured but also the thickness of the applied coating can be adjusted.

In the gravure coating device of the type described above with reference to FIGS. 3 and 4, a plurality of webs 11 can be transported through the device and coating of different colors can be supplied for respective webs 11 so that respective webs are coated with the coating agents of different colors, respectively, in a very satisfactory manner.

More particularly, coating in blue, red and yellow are, or instance, fed to three gravure coating devices and the gravure coating devices are maintained at their lowered positions until a portion of the undersurface of the web 11 which must be coated with the coating of a specific color passes the gravure coating devices. When said portion of the web enters one of the gravure coating devices having a specific color coating, the gravure coating device is raised so that the engraved portion 17 of the gravure roll 13 applied with the coating having said specific color is made into contact with the undersurface of the web 11. In this way, the coating having various colors can be applied to predetermined portions of the undersurface of the web 11.

According to the present invention, even when the waiting period is long, a suitable or predetermined quantity of the coating can be fed to the engraved portion 17 by means of the doctor blade 25 when the coating operation is stated so that the phenomenon that the coating is applied too much to the leading portion of the web as in the case of the coating operation with the coating device with a wire bar can be eliminated, whereby the coating can be applied in a uniform thickness to the web.

Multi-color coating can be accomplished by a prior art gravure coating device of the type in which the web is clamped between two rolls as shown in FIG. 2, an offset gravure coating device or a flexographic printing press, but there arises a problem that when a thin web is clamped between the rolls, longitudinal wrinkles are produced on the surfaces of the thin web so that it is difficult to coat the web in a satisfactory manner. In addition, the two rolls must be moved toward or away from each other so that the prior art gravure devices are large in size and complex in construction and expensive to manufacture.

On the other hand, according to the present invention, the gravure coating device capable of multi-color coating can be made simple in construction, compact in size and inexpensive to manufacture. Especially the required installation space and the cost can be reduced to $\frac{1}{8}$ to $\frac{1}{3}$ of the prior art gravure coating devices.

What is claimed is:

1. A gravure coating device for applying a coating to a first side of a longitudinally traveling continuous web comprising:

a. a pair of spaced apart extension rollers rotating about transverse axes, contacting a second side of said web and advancing said web in a manner that said web is substantially unbowed between said extension rollers;

b. a gravure roll for applying coating to said first side of said web, tangentially contacting said web first side from beneath said web, intermediate said extension rollers, said second side of said web at and proximate said gravure roll being unrestrained;

c. a doctor blade for wiping excess coating from said gravure roll prior to contact between said gravure roll and said web, said doctor blade being pivotally rotatable about an axis generally parallel with the axis of rotation of said gravure roll, to move against or away from said gravure roll about said pivot;

d. a nozzle for applying said coating material to said gravure roll at a position generally diametrically opposite and below said position of gravure roll-web contact, said nozzle comprising:

i. a pair of transversely elongated nozzle blocks below and generally parallel with the axis of rotation of said gravure roll, said nozzle blocks being closely spaced one to another and having transversely extending, respectively diverging surfaces defining a trough-like nozzle outlet, said respective diverging surfaces being at substantially a common angle respecting a throat of said nozzle with said trough-like nozzle outlet communicating with said nozzle throat, said diverging surface of said nozzle block first proximately encountered by said gravure roll surface as said gravure roll rotates being further from said gravure roll surface at a point of closest approach therebetween than a corresponding diverging surface of said nozzle block of said pair secondly approached by said gravure roll surface as said gravure roll rotates, said diverging surfaces extending towards said web and terminating at surface extremities which are separated from said web less than diameter of said gravure roll, with a portion of said gravure roll being interposed between said diverging surface extremities;

ii. said nozzle throat being defined by space between said respective nozzle blocks and being separated from said gravure roll by said diverging surfaces;

iii. said nozzle blocks including respective mutually facing recesses defining a coating reservoir communicating with said nozzle throat and separated from said gravure roll by said nozzle throat and said diverging surfaces;

iv. means interposed between said respective nozzle blocks at mutually facing surfaces thereof, for spacing said nozzle blocks apart to define said nozzle throat intermediate said reservoir and said nozzle outlet;

v. means for transversely confining said coating material within said nozzle along the axial length of said gravure roll, said coating confining means closely fitting about the periphery of said gravure roll and said diverging surfaces of said nozzle block, said nozzle throat and said nozzle reservoir, to retain said coating material in the coating reservoir, the nozzle throat and a trough defined by said respective diverging planar surfaces within a selected axial regain between respective ones of said confining means; said confining means extending from said respective nozzle blocks towards said traveling continuous web to define, with said gravure roll and said nozzle blocks, a confined trough-like coating bath within which said coating emanating from said nozzle throat is applied to a lower said gravure roll.

2. The device of claim 1 wherein said diverging surfaces are planar.

3. The device of claim 2 wherein said reservoir is generally cylindrical with an axis parallel the axis of said gravure roll.

4. The device of claim 3 wherein said trough-like nozzle outlet is unsymmetrical in transverse cross-section.

5. The device of claim 4 wherein each of said surface extremities of said diverging surfaces are separated from said web by the same distance.

6. In a gravure coating device for applying a coating to a longitudinally traveling continuous web including means for advancing said web past a gravure roll, a gravure roll for applying coating to said web by contacting said web and a doctor blade for wiping excess coating from said gravure roll prior to contact between said gravure roll and said web, improved nozzle means for applying said coating material to said gravure roll at a position generally diametrically opposite and below said position of gravure roll-web contact, comprising:

a. a pair of transversely elongated nozzle blocks below and generally parallel with the axis of rotation of said gravure roll, said nozzle blocks being closely spaced one to another and having transversely extending, respectively diverging surfaces defining a trough-like nozzle outlet, said respective diverging surfaces being at substantially a common angle respecting a throat of said nozzle with said trough-like nozzle outlet communicating with said nozzle throat, said diverging surface of said nozzle block first proximately encountered by said gravure roll surface as said gravure roll rotates being further from said gravure roll surface at a point of closest approach therebetween than a corresponding diverging surface of said nozzle block of said pair secondly approached by said gravure roll surface as said gravure roll rotates, said diverging surfaces extending towards said web and terminating at surface extremities separated from said web less than diameter of said gravure roll, with a lower portion of said gravure roll being interposed between said diverging surface extremities;

b. said nozzle throat being defined by space between said respective nozzle blocks and being separated from said gravure roll by said diverging surfaces;

c. said nozzle blocks including respective mutually facing recesses defining a coating reservoir communicating with said nozzle throat and separated from said gravure roll by said nozzle throat and said diverging surfaces;

d. means interposed between said respective nozzle blocks at mutually facing surfaces thereof, for spacing said nozzle blocks apart to define said nozzle throat intermediate said reservoir and said nozzle outlet;

e. means for transversely confining said coating material within said nozzle along the axial length of said gravure roll, said coating confining means closely fitting about the periphery of said gravure roll and said diverging surfaces of said nozzle block, said nozzle throat and said nozzle reservoir, to retain said coating material in the coating reservoir, the nozzle throat and a trough defined by said respective diverging surfaces within a selected axial region between respective ones of said confining means; said confining means extending from said respective nozzle blocks towards said traveling continuous web to define, with said gravure roll and said nozzle blocks, a confined trough-like coating bath within which said coating emanating from said nozzle throat is applied to a lower portion of said gravure roll by passage of said gravure roll lower portion through said coating bath.

7. The device of claim 6 wherein said diverging surfaces are planar.

* * * * *